US006958662B1

(12) United States Patent
Salmela et al.

(10) Patent No.: US 6,958,662 B1
(45) Date of Patent: Oct. 25, 2005

(54) WAVEGUIDE TO STRIPLINE TRANSITION WITH VIA FORMING AN IMPEDANCE MATCHING FENCE

(75) Inventors: Olli Salmela, Helsinki (FI); Markku Koivisto, Espoo (FI); Mikko Saarikoski, Espoo (FI); Kalle Jokio, Espoo (FI); Ali Nadir Arslan, Espoo (FI); Esa Kemppinen, Helsinki (FI); Vesa Korhonen, Helsinki (FI); Teppo Miettinen, Vantaa (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/399,480

(22) PCT Filed: Oct. 18, 2000

(86) PCT No.: PCT/EP00/10238

§ 371 (c)(1),
(2), (4) Date: Sep. 22, 2003

(87) PCT Pub. No.: WO02/33782

PCT Pub. Date: Apr. 25, 2002

(51) Int. Cl.[7] ..... H01P 5/107
(52) U.S. Cl. ..... 333/26; 333/247; 333/33
(58) Field of Search ..... 333/26, 33, 247, 333/254

(56) References Cited

U.S. PATENT DOCUMENTS

| | | | |
|---|---|---|---|
| 5,414,394 A | 5/1995 | Gamand et al. | |
| 6,060,959 A * | 5/2000 | Yakuwa | 333/26 |
| 6,356,173 B1 * | 3/2002 | Nagata et al. | 333/247 |

FOREIGN PATENT DOCUMENTS

| | | |
|---|---|---|
| EP | 0 249 310 A1 | 12/1987 |
| EP | 0 874 415 A2 | 10/1998 |
| EP | 0 920 071 A2 | 6/1999 |

OTHER PUBLICATIONS

"A Compact MMIC-Compatible Microstrip to Waveguide Transition", Hyvönen et al, IEEE MTT-S International Microwave Symposium Digest, Jun. 17, 1996, pp. 875-878.
Patent Abstracts of Japan, vol. 018, No. 022, Jan. 13, 1994 & JP 05 259715 A.
Patent Abstracts of Japan, vol. 1999, No. 14, Dec. 22, 1999 & JP 11 261312 A.

* cited by examiner

*Primary Examiner*—Benny Lee
(74) *Attorney, Agent, or Firm*—Squire, Sanders & Dempsey L.L.P.

(57) ABSTRACT

The invention relates to a device for guiding electromagnetic waves from a wave guide (10), in particular a multi-band wave guide, to a transmission line (20), in particular a micro strip line, arranged at one end of the wave guide (10), comprising coupling means (30-1, . . . , 30-7) for mechanical fixation and impedance matching between the wave guide (10) and the transmission line (20). It is the object of the invention to improve such a structure in the way that manufacturing is made easier and less expensive than according to prior art. According to the present invention that object is solved in the way that the coupling means comprises at least one dielectric layer (30) being mechanically connected with the main plane of the transmission line, the geometric dimension of that at least one dielectric layer extending along the propagation direction of the electromagnetic waves being correlated with the center frequency of electromagnetic waves in order to achieve optimised impedance matching.

17 Claims, 8 Drawing Sheets

WAVEGUIDE TO STRIPLINE TRANSITION WITH VIA FORMING AN IMPEDANCE MATCHING FENCE

BACKGROUND OF THE INVENTION

1. Field of the Invention

The invention relates to a device for guiding electromagnetic waves from a wave guide, in particular a multi-band wave guide, to a transmission line, in particular a microstrip line, arranged at one end of the wave guide, comprising coupling means for mechanical fixation and impedance matching between the wave guide and the transmission line.

One problem for devices of that kind is to ensure a good transmission of electrical power in the wave guide to transmission line transition. Poor transition results in large insertion loss and this may degrade the performance of the whole module, e.g. a transceiver module.

2. Description of the Related Art

A device with a structure known in the prior art is shown in FIG. 9. There is shown a wave guide 10 and a transmission line 20, in particular a micro strip structure which are attached to each other for enabling transition of electromagnetic waves from the wave guide 10 to the transmission line 20. The transmission line 20 comprises a substrate 22 which is attached to a ground plane 24 for achieving good transition characteristics. The substrate 22 of the transmission line is typically made from low or high temperature co-fired ceramic LTCC or HTCC.

Impedance matching between the wave guide 10 and the transition line 20 is completed by providing a patch 26 in the transition area between the wave guide 10 and the transition line 20. Moreover, for improving impedance matching there is provided a separate slab 12 from dielectric material fastened within the wave guide 10. The slab 12 is, for example, attached within said wave guide 10 between machined shoulders 14.

The prior art approach for achieving impedance matching is based on a complex structure which can only be realised in a difficult and expensive manufacturing process. Moreover, quite often so-called back-shorts are used i.e. a metal part is attached behind the micro strip 20 opposite the opening of the wave guide 10 in order to achieve impedance matching. Attaching the back-short further increases the complexity of the structure.

SUMMARY OF THE INVENTION

It is the object of the present invention to improve the known device for guiding electromagnetic waves in a way that the manufacturing process is made easier and less expensive.

More specifically, the object is solved for the structure described above in the way that the coupling means comprises at least one dielectric layer being mechanically connected with the main plane of the transmission line, the geometric dimension of that at least one dielectric layer which extends along the propagation direction of the electromagnetic waves being correlated with the center frequency of the electromagnetic waves.

Because the mechanical fixation function and the electrical impedance matching function are integrated into one single component the manufacturing process of the layer structure is easy and inexpensive.

Impedance matching is achieved according to the present invention by varying the thickness of the at least one dielectric layer between the wave guide and the transmission line. The layer structure can, even if it comprises several layers, be considered as only one element used for achieving impedance matching. Thus, the adjustment process for achieving impedance matching is facilitated.

A preferred example is that the transmission line is an integral part of the coupling means. In that case the entire transition structure is co-fired in a multilayer ceramics manufacturing process.

A further preferred feature to enable optimised impedance matching is to provide metallised vias within a layer in order to build up a fence-like structure to further guide the waves after the have left the end of the wave guide.

Further preferably, there is at least one additional layer provided between the transmission line or the at least one layer and the wave guide, the additional layer comprising an air-filled cavity. The additional layer strengthenes the mechanical stability of the structure and the air-filled cavity ensures that the additional layer does not influence the transition characteristics of the structure.

It is advantageous that the cavity is aligned with an opening of the wave guide because in that case the influence of the additional layer to the transition characteristics of the structure is reduced to a minimum.

Furthermore, it is advantageous that the attachment of the wave guide to the layer adjacent to the wave guide is a solder ball connection because in that case self-aligning characteristics of the solder ball connections can be used.

BRIEF DESCRIPTION OF THE DRAWINGS

The invention is described in detail in the following accompanying figures, which are referring to preferred embodiments, wherein.

DETAILED DESCRIPTION OF THE PREFERRED EMBODIMENTS

Figure 1:
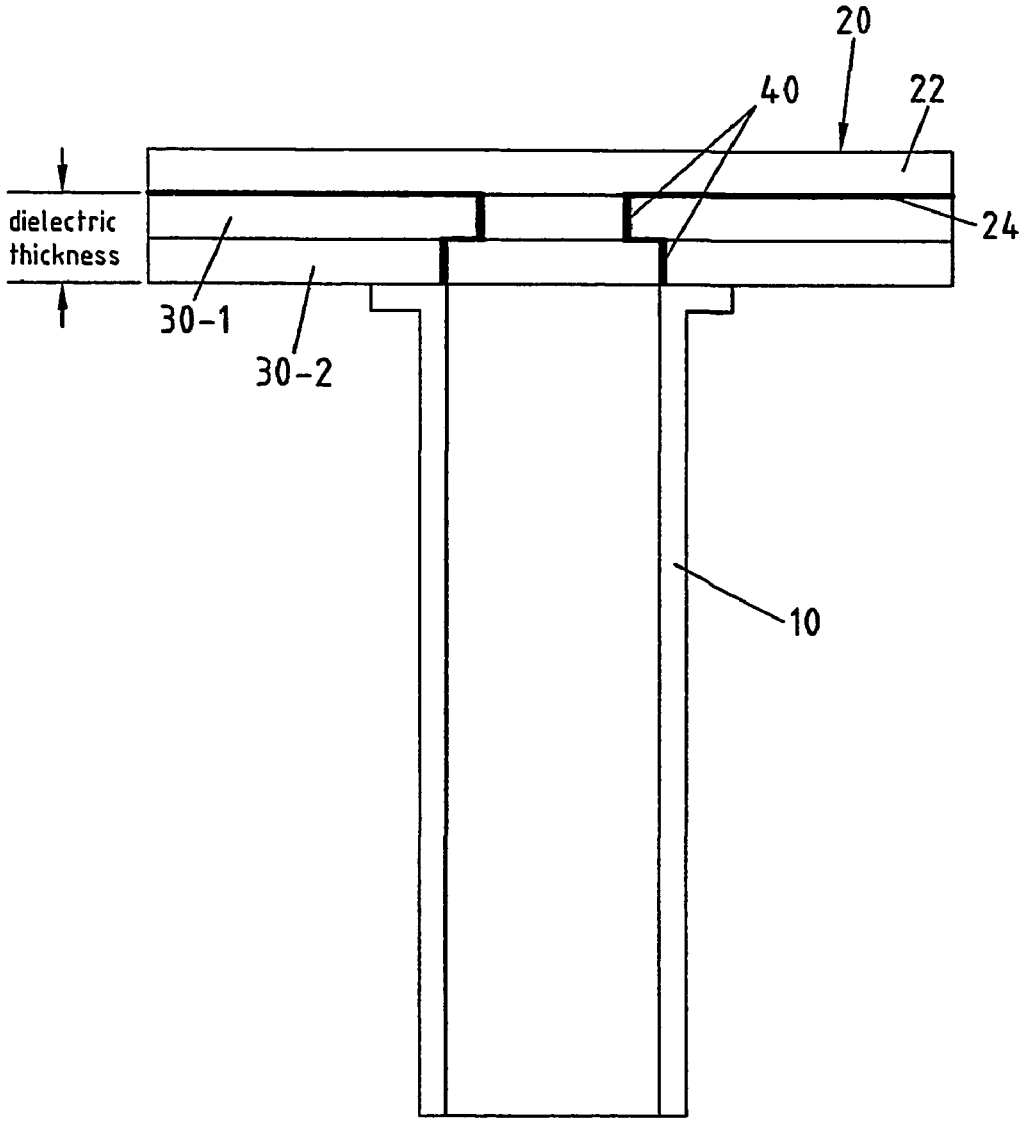
FIG. 1 discloses a first embodiment of a structure according to the present invention.

FIG. 1 shows a structure for guiding electromagnetic waves according to a first embodiment of the invention. The structure comprises a wave guide 10 and a transmission line 20, the substrate layer 22 of which is arranged perpendicular to the longitudinal axis of the wave guide 10 for transition of electromagnetic waves from the wave guide 10 to the transmission line 20. There are two layers 30-1 and 30-2 provided as coupling means, the layers 30-1, 30-2 being arranged between the substrate layer 22 of the transmission line 20 and the wave guide 10, wherein the dielectric thickness of the layers 30-1, 30-2 is adjusted in a way described below.

Each of the layers 30-1, 30-2 comprises metallised through-holes 40, called "vias", forming a fence-like structure surrounding the area of each layer 30-1, 30-2, respectively, through which the wave should be guided. Vias of different layers are interconnected with each other and with a metallised layer 24 at the bottom side of the substrate layer 22 of the transmission line 20.

Figure 2:
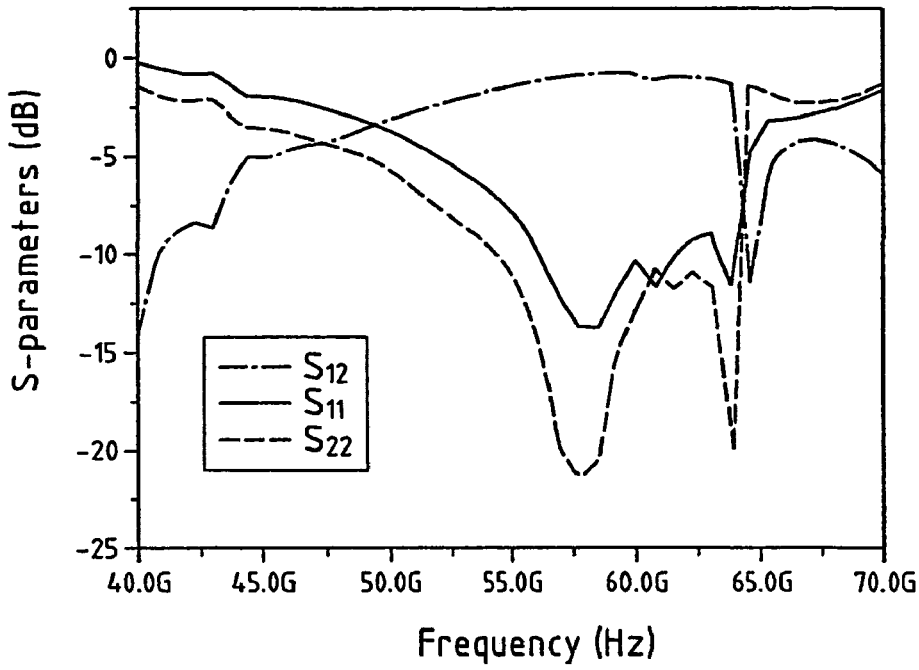
FIG. 2 is a diagram illustrating the transition characteristics of a wave guide to microstrip transition according to the present invention.
Figure 3:
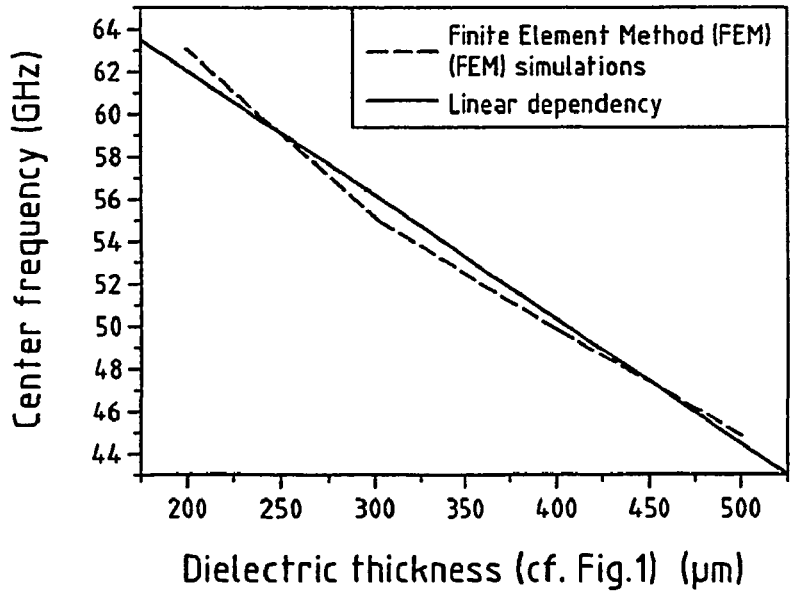
FIG. 3 is a diagram illustrating the relationship between the centre frequency and the dielectric thickness for optimal impedance matching in a structure according to the present invention.
Figure 4:
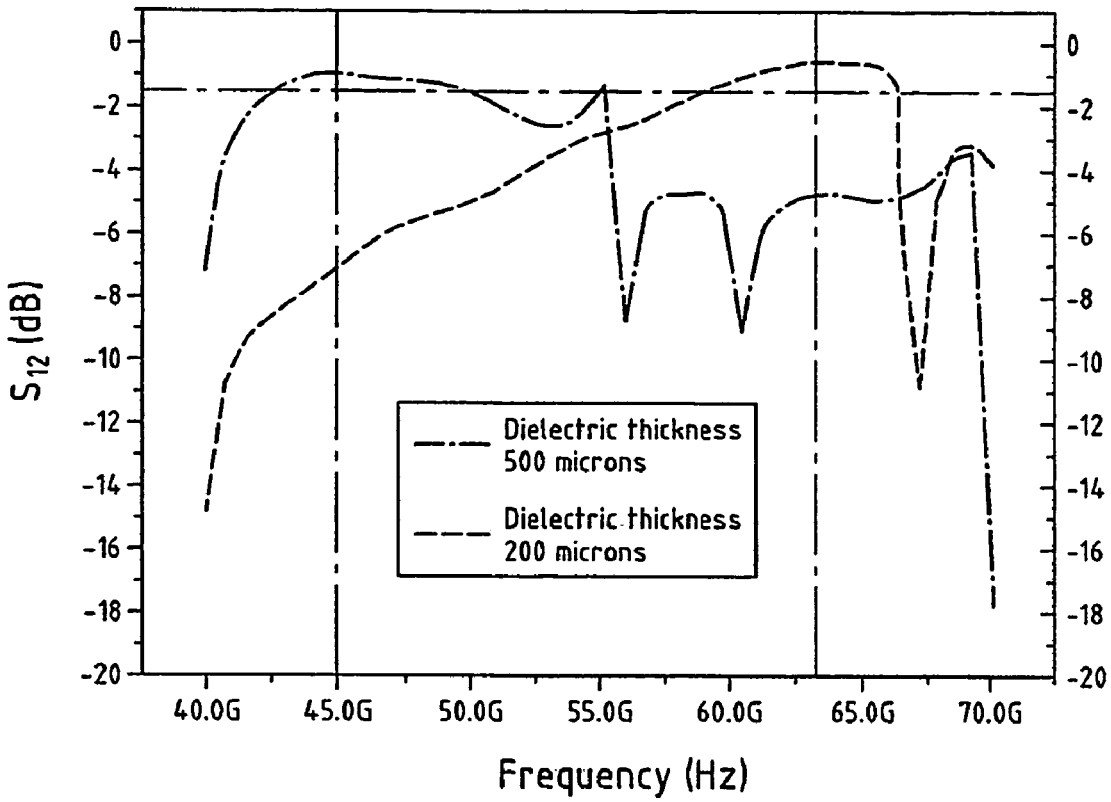
FIG. 4 is a diagram illustrating the transition characteristics of a wave guide to micro strip transition or to a structure according to the present invention wherein the thickness of the layers in the structure is varied.

The influence of a variation of the thickness of the layers 30-1 and 30-2 on the transition characteristics of the structure according to FIG. 1 will be illustrated in more detail by referring to FIGS. 2 to 4.

FIG. 2 illustrates the electrical characteristic of the structure according to FIG. 1. FIG. 2 shows the frequency curves of the transmission coefficient ($S_{12}$), the reflection coefficient ($S_{11}$) measured from port 1 and the reflection coefficient ($S_{22}$) measured from port 2, respectively. More specifically, it can be seen that at a centre frequency of 58 GHz and a thickness of the dielectric layer of 250 microns the characteristics are quite good. The curve $S_{11}$, representing the return loss of the structure for different frequencies, shows that the return loss at the centre frequency of 58 GHz is smaller than 13.5 dB, while the insertion loss, represented by the curve $S_{12}$, is 0.8 dB.

Moreover, the −1.5 dB bandwidth reaches from 55 . . . 64 GHz, meaning that the transition is not sensitive to tolerances or manufacturing process fluctuations.

FIG. 3 illustrates that the centre frequency of the passband of the structure according to FIG. 1 has a linear dependency of the dielectric substrate thickness. That dependency, which is the result of a finite-element method simulation, means that just by selecting a suitable dielectric thickness one can easily adjust the centre frequency of the transition.

FIG. 4 illustrates the insertion losses for a wave guide to micro strip transition of a structure according to FIG. 1 for different thicknesses of the dielectric layers. The insertion loss represented by the parameter $S_{12}$ is illustrated in FIG. 4 for a dielectric thickness of 200 and 500 microns. The centre frequency of the −1.5 dB bandwidth lies in the case of a dielectric thickness of 200 microns at 63 GHz whereas for a layer thickness of 500 microns the centre frequency lies at 45 GHz. In both cases the bandwidth is approximately 7.5 GHz.

As illustrated above besides varying the thickness of the layers impedance matching can further be influenced and be improved by placing via-fences in the dielectric layer(s) and/or the substrate to define lateral dimensions of the continuation of the wave guide and thus, effect inter alia the insertion loss.

Figure 5:
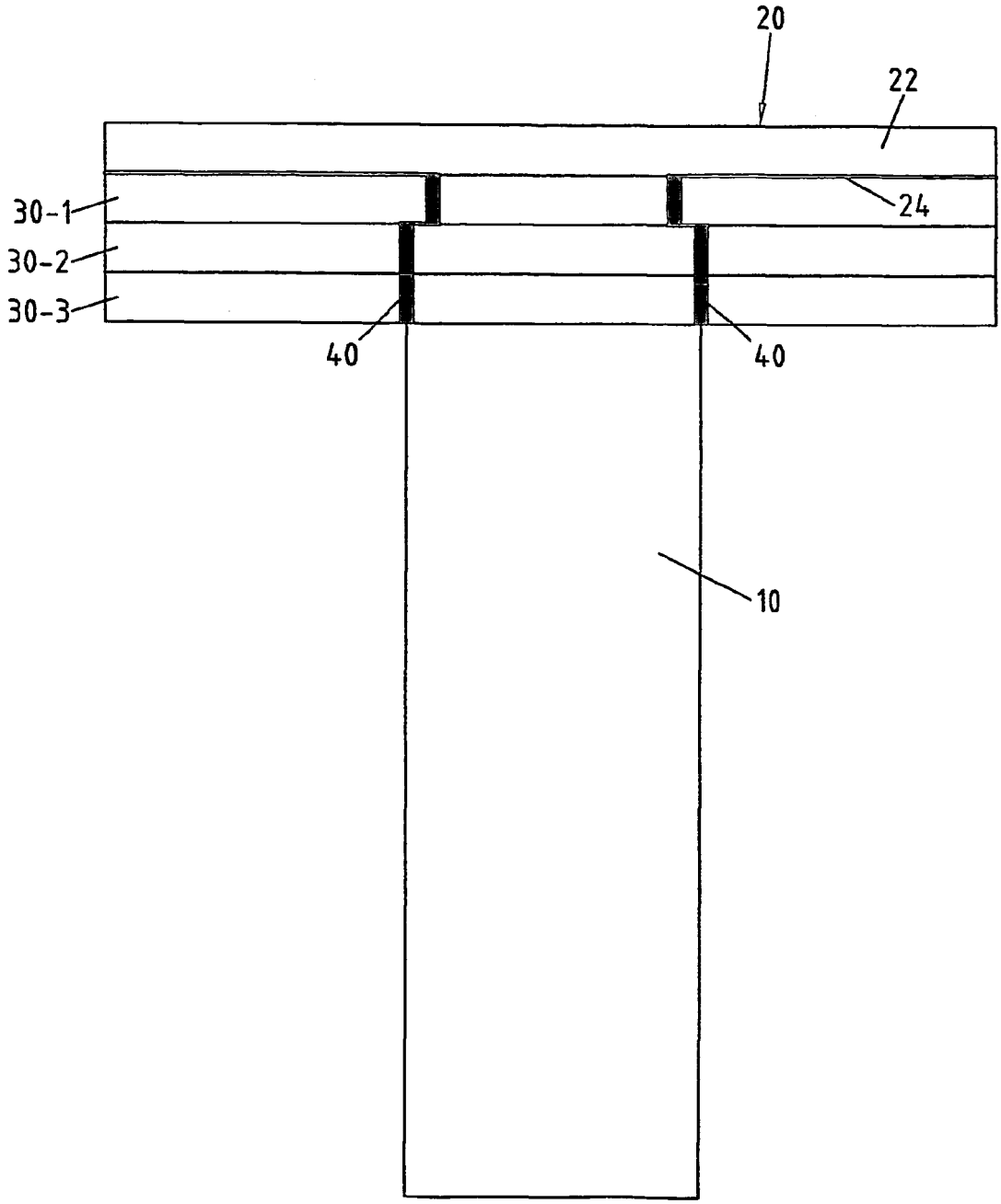
FIG. 5 shows a second embodiment of the structure according to the present invention.

FIG. 5 shows a second embodiment of a structure according to the present invention in which three layers, 30-1, 30-2, 30-3, between the substrate 22 of the transmission line 20 and the wave guide 10 comprises vias 40. Quite often it is sufficient to optimise just only the dimensions of the layer 30-1 directly beneath the micro strip ground plane 24 and to keep elsewhere in the substrate the dimensions equal to the cross-sectional area of the metal wave guide 10. In general it appears that the larger the dimensions of the wave guide continuation structure in the dielectric substrate of the layers 30-1, 30-2, 30-3 and the transmission line 20, the smaller the insertion loss.

According to the present invention the preferred material for the dielectrical layers is low or high temperature co-fired ceramic LTCC or HTCC.

Figure 6:
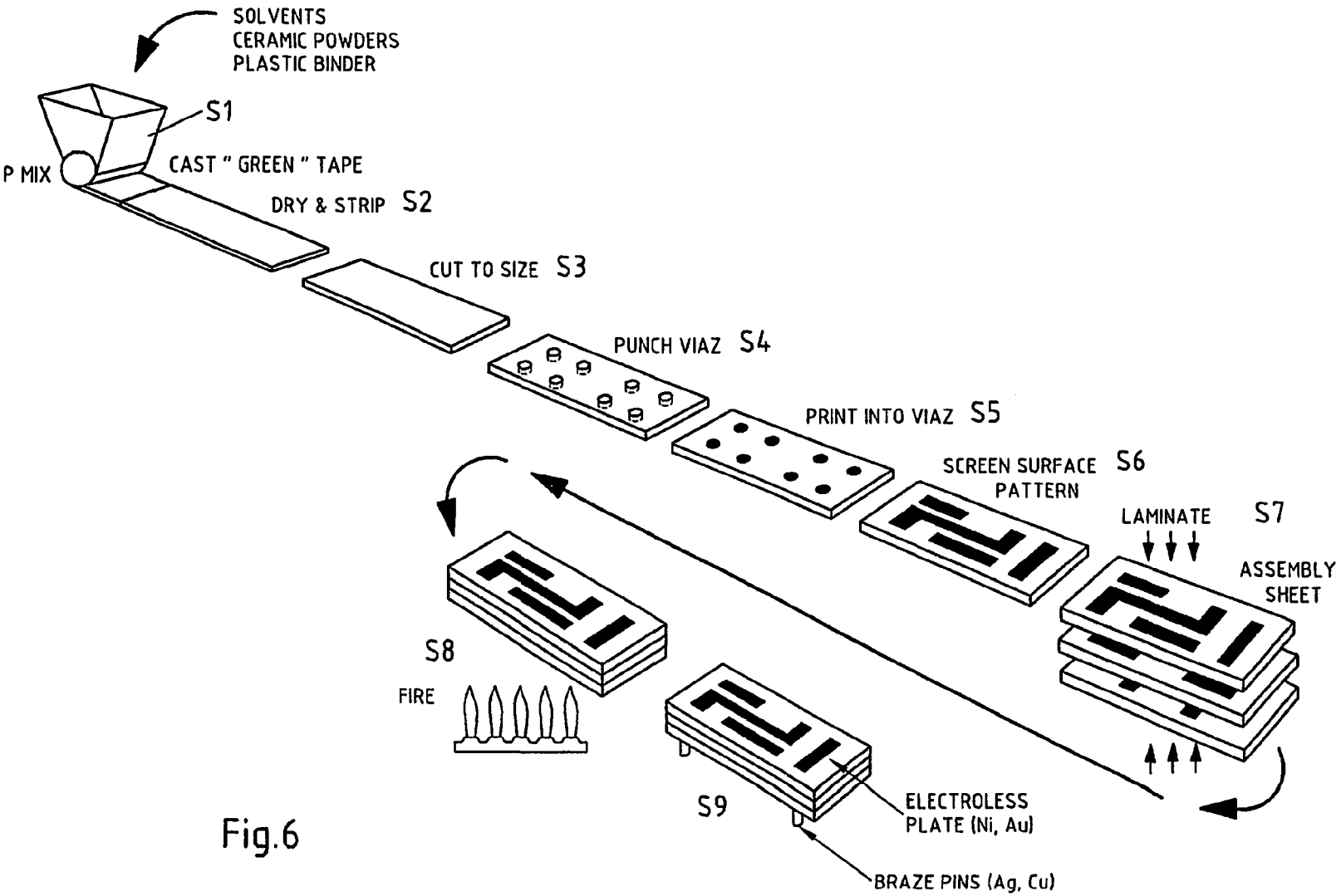
FIG. 6 illustrates a manufacturing process for layers comprising vias.

The process for manufacturing said layers comprising vias is illustrated in FIG. 6. In a first step S1, the substrate is generated by mixing solvents, ceramic powder and plastic binder (PMIX) and generating substrate tapes (CAST "GREEN" TAPE). After drying and stripping (method step S2) and cutting out to size (method step S3) vias are punched into said substrate (method step S4.) Normally the diameter of the vias is about 100 to 200 $\mu$m. After punching of the vias, the vias of each individual layer are filled by a conductor paste like silver, copper or tungsten, see method step printing into vias S5. After that, several layers are collected and are fired together as known from a normal manufacturing step of co-fired ceramic technology. These final method steps are illustrated in more detail in FIG. 6 wherein after method step S5 conducting pads with a given surface pattern are screened on the layer according to method step S6, several layers are laminated together in method step S7 and after that, the layer assembly is fired according to method step S8. Finally braze pins are attached to the fired layer assembly of Electroless Plate (Ni, Au) according to method step S9.

Figure 7:
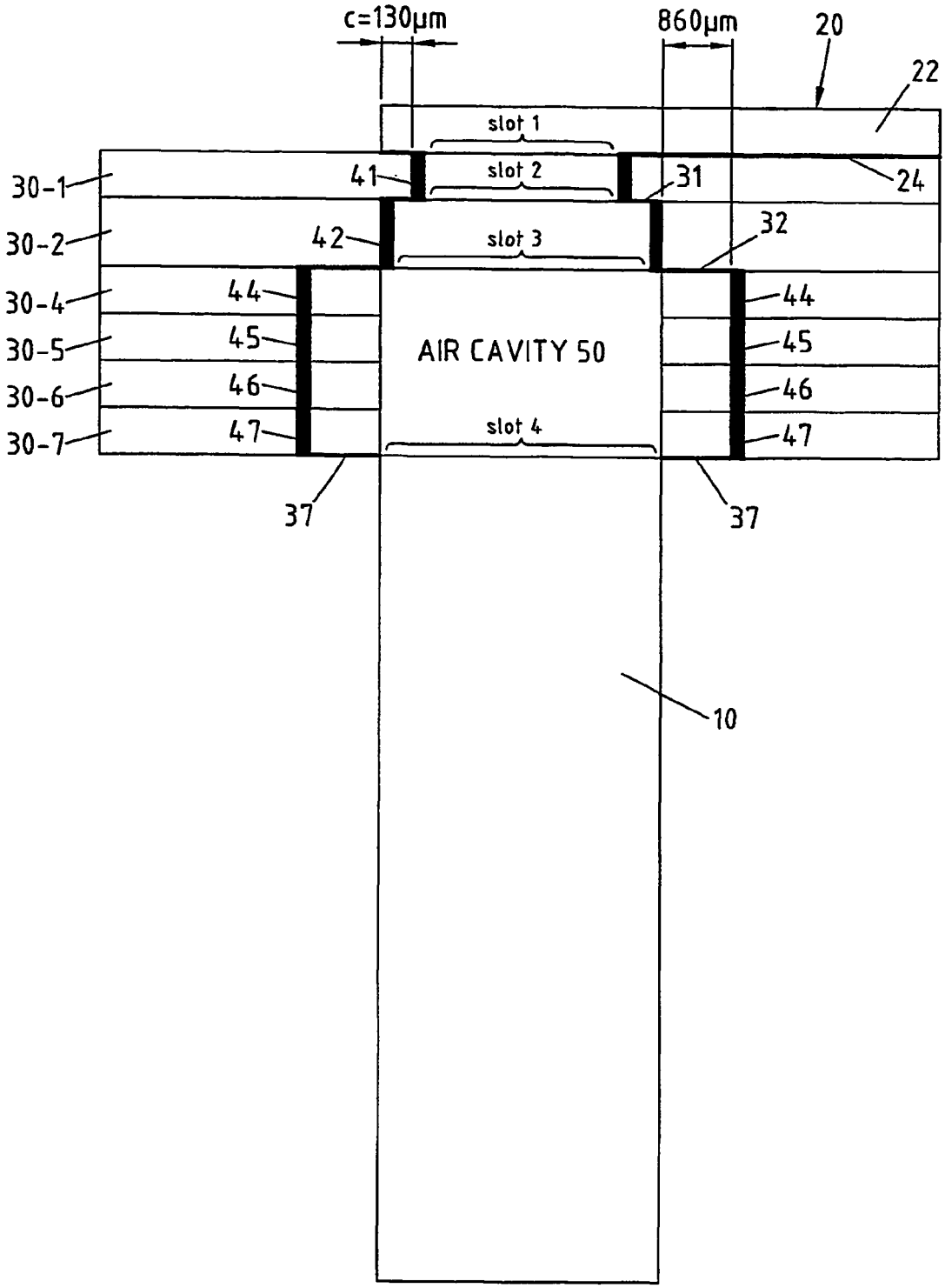
FIG. 7 shows a third embodiment of a structure according to the present invention.

FIG. 7 shows a third embodiment for a structure for guiding electromagnetic waves according to the present invention. It substantially corresponds to the structure shown in FIG. 5 however, the implementation of the vias in the layers is shown in more detail and layers 30-4, 30-5, 30-6, and 30-7 are additionally comprised within the structure.

Whereas in FIG. 5 all layers 30-1, . . . 30-3 have the same thickness, the thickness of layer 30-2 in FIG. 7 has been varied in order to achieve good impedance matching. For example, for achieving good impedance matching at a particular frequency of 60 GHz it has been found that the appropriate thickness of layers 30-1 and 30-4 to 30-7 shall be 100 $\mu$m, whereas the thickness of layer 30-2 is proposed to be 150 $\mu$m.

The vias in the dielectric substrate layers do not only influence the impedance matching but also have an important roll in the mechanical design of the structure because they preferably connect the ground planes 24, 31, 32 of the transmission line 20 and of different layers 30-1, 30-2. In that way the vias ensure mechanical stability of the structure. However, if there are only very few layers provided between the transmission line 20 and the coplanar wave guide 10 the resulting structure may still be mechanically fragile. To prevent this, additional layers 30-4, 30-5, 30-6, 30-7 may be added to the substrate. These additional layers preferably build up an air-filled cavity 50 aligned to the opening of the coplanar wave guide 10 in order not to change the desired electric characteristics of the structure by changing the dielectric thickness and consequently the resulting centre frequency. The structure can further be strengthened by using a metal base plate 37 having a slot 4 aligned with the opening of the coplanar wave guide 10.

The ground plane 24 of the transmission line 20 as well as the ground planes 31, 32 and 37 of layers 30-1, 30-2 and 30-7 have slots slot 1, slot 2, slot 3, slot 4 in order to ensure a proper transition of electromagnetic waves from the wave guide 10 to the transmission line 20. These slots may be delimited by the via fences 41, 42 of the respective layers 30-1, 30-2. However, the air-filled cavity 50 and the co-ordinated slot 4 in base plane 37 of layer 30-7 can be limited either by the dielectric substrate material itself or by the substrate material and vias 44, 45, 46, and 47 placed on each side of the cavity 50. While quite often the design rules prevent to place the vias close to the cavity 50 a better solution is to place the vias 50 half-wavelength away from the cavity edge; e.g. in FIG. 7 the vias 44, 45, 46, and 47 are placed at a distance of 860 $\mu$m away from the cavity edge. Half-wavelength distance of the vias from the wave guide opening or the cavity edge in that part of the structure which is close to the wave guide 10 is preferably selected because at that distance the reflection coefficient $\rho$ is $\rho=-1$, which means that such an arrangement gives almost equal performance to the case that the cavity walls have been totally metallised (half-wavelength demand comes from the fact that standing waves have a half-wavelength periodicy meaning that in effect the cavity walls seem to be in zero potential). The proposed half-wavelength arrangement also prevents any electromagnetic leakage into/from the structure.

The vias obviously improve the transition of electromagnetic waves from a wave guide 10 to a transition line 20 but they are not mandatory in every layer.

Figure 8:
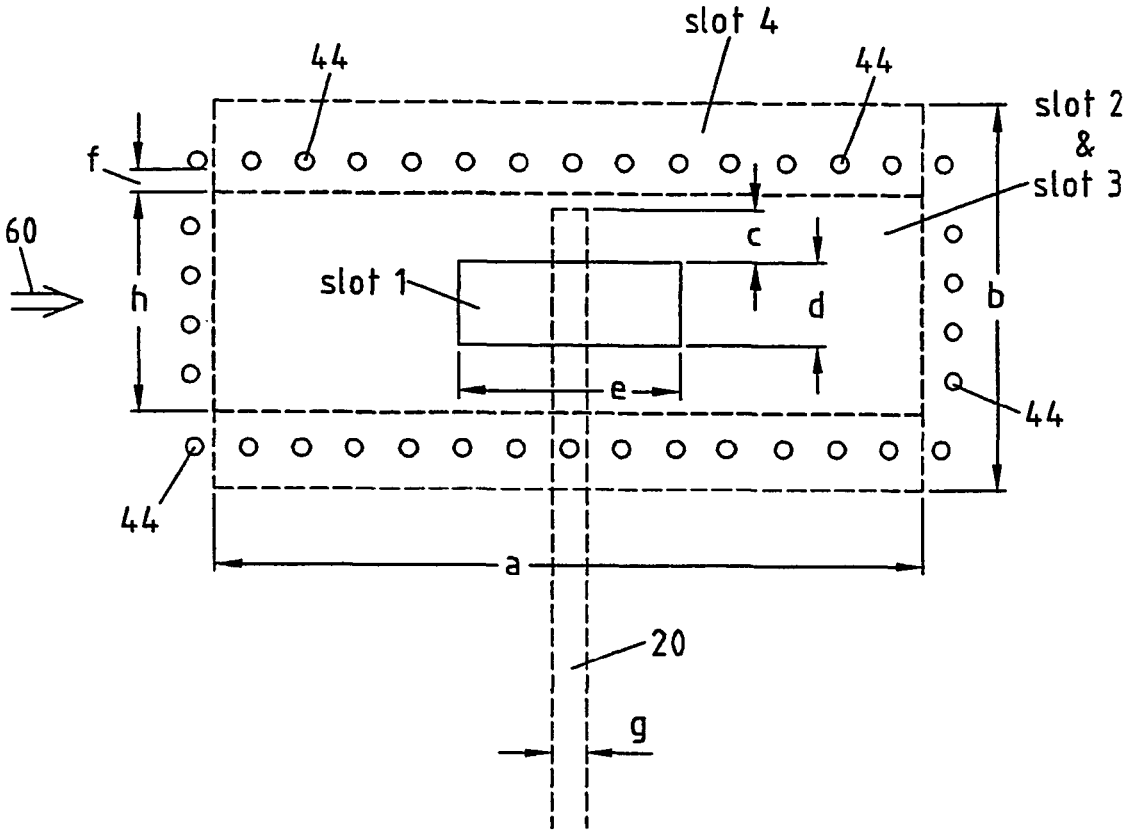
FIG. 8 is a top view of the structure shown in FIG. 7.
Figure 9:
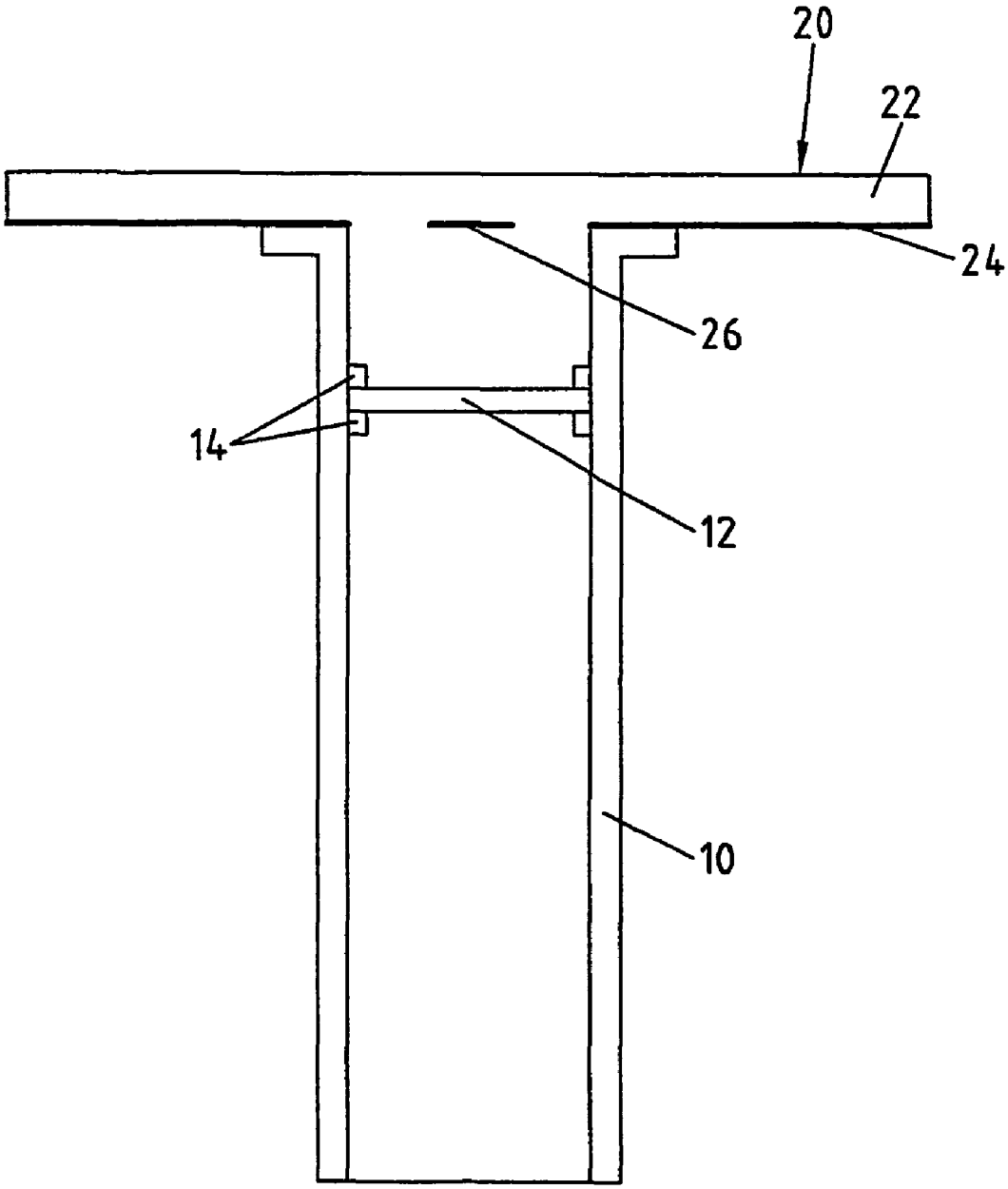
Fig.9 prior art
FIG. 9 shows a structure for guiding waves known from the prior art.

FIG. 8 shows a top view of the structure according to FIG. 7 wherein arrow 60 indicates the view direction of FIG. 7. Reference numeral 20 indicates the transmission line, in particular a micro strip structure having a width g of g=110 $\mu$m. The transmission line 20 has a dielectric thickness of 100$\mu$ (see FIG. 7) and extends a distance c=130 $\mu$m over slot 1 in the micro strip ground plane 24 (see FIG. 7). The area covered by slot 1 in the ground plane 24 measures in the example according to FIG. 8 e×d wherein e=1840$\mu$ and d=920 $\mu$m.

Slots 2 and 3 of FIG. 7 are represented by the thick dashed line in FIG. 8 covering an area of h×a wherein h=1200$\mu$ and a=3760 $\mu$m. The thick dashed line also represents the via fences 41 and 42 since these via fences should be placed as close as possible to the edge of the respective ground planes 31 and 32 (see FIG. 7).

FIG. 8 further shows a top view on vias 44 of layer 30-4 (see FIG. 7). It is apparent that these via fences 44 and the via fences 45, 46, 47 of the beneath layers 30-5, 30-6 and 30-7 are positioned at a distance f, wherein f=860 $\mu$m from the edge of slot 3 which substantially corresponds to the edge of air cavity 15; the reasons for placing vias 44–47 at a distance to the edge of the air cavity 50 have been explained above.

Slot 4 represents the cross-sectional area a×b of the air cavity in layers 30-4, 30-5, 30-6, and 30-7 according to FIG. 7. In the example of FIG. 8, a=3760$\mu$ and b=1880$\mu$, wherein that area corresponds to the cross-sectional area of the opening of wave guide 10 and is aligned thereto.

The wave guide 10 can be attached to the adjacent layer 30-7 by using different mechanical approaches: e.g. by soldering or even using solder balls, e.g. BGA (Ball Grid Array) type of solder attachment. Using a solder ball connection has the advantage that self-aligning effects of the technology can be used. On the other hand when using solder ball connections there may be small air gaps between the connection between the wave guide 10 and the adjacent layer, however these very small air gaps do not substantially influence the electrical characteristics of the structure; thus, no direct contact between the wave guide 10 and the ceramic material of the layer is required.

Although the invention has been described for the usage of multilayer ceramics the substrate material of the transmission line 20 and of the layers 30-i, where i=1, 2, 3, 4, 5, 6, or 7, may also be laminate material. The transmission line may be a micro strip, a stripline or a coplanar wave guide.

What is claimed is:

1. Device for guiding electromagnetic waves from a wave guide, to a transmission line, arranged at one end of the wave guide, comprising coupling means for mechanical fixation and impedance matching between the wave guide and the transmission line, where the coupling means comprises at least two dielectric layers being mechanically connected with a main plane of the transmission line, and where, in the at least two dielectric layers, a plurality of electrically conducting vias provide a fence-like arrangement and define the lateral dimensions of the part of the at least two dielectric layers effective for the transition of the waves, wherein said lateral dimensions of at least one of the at least two dielectric layers differ from the lateral dimensions of the other dielectric layers in a way that optimised impedance matching for a given center frequency of the electromagnetic waves is achieved, and wherein the thickness of at least one of the at least two dielectric layers differs from the thickness of the other dielectric layers and that the thickness of said at least one of the at least two dielectric layers is determined in a way that optimised impedance matching for a given center frequency of the electromagnetic waves is achieved.

2. The device according to claim 1, wherein a metal layer is arranged in a sandwich structure of dielectric layers adjacent to a substrate layer of the transmission line.

3. The device according to claim 1, wherein at least one additional layer is provided within the coupling means, said additional layer confining an air filled cavity.

4. The device according to claim 3, wherein the cavity is aligned with an opening of the wave guide.

5. The device according to claim 1, wherein the attachment of the wave guide to the dielectric layer adjacent to the wave guide is made by a soldering or welding or glueing connection.

6. The device according to claim 5, wherein the soldering connection is using solder balls.

7. The device according to claim 1, wherein the lateral dimension of the fence via structure in an additional layer is located in half wave length distance from the cavity.

8. The device according to claim 1, wherein the transmission line is a microstrip line.

9. The device according to claim 1, wherein the transmission line is a stripline.

10. The device according to claim 1, wherein the transmission line is a coplanar wave guide.

11. The device according to claim 1, wherein the vias are electrically connected with conducting pads according to given surface patterns, the pads extending along at least one main area of the at least two dielectric layers.

12. The device according to claim 11, wherein conducting pads of adjacent dielectric layers are electrically connected to each other.

13. The device according to claim 1, wherein the vias of different dielectric layers are adjacent to each other.

14. The device according to claim 1, wherein each of said dielectric layers has a predetermined thickness in a way that the total dielectric thickness of a sandwich structure of dielectric layers is adapted to the center frequency of the electromagnetic waves.

15. The device according to claim 1, wherein the vias in said at least two dielectric layers comprise a variety of staggered vias in different dielectric layers.

16. The device according to claim 1, wherein the structure comprising at least one dielectric layer is soldered or welded, to a substrate layer of the transmission line.

17. The device according to claim 1, wherein the transmission line is an integral part of the coupling means.

* * * * *